US005470655A

United States Patent [19]

Hirai

[11] Patent Number: 5,470,655

[45] Date of Patent: Nov. 28, 1995

[54] POLYTETRAFLUOROETHYLENE FILAMENTARY MATERIAL

[75] Inventor: Kengo Hirai, Okayama, Japan

[73] Assignee: Japan Gore-Tex, Inc., Japan

[21] Appl. No.: 307,863

[22] Filed: Sep. 15, 1994

[30] Foreign Application Priority Data

Sep. 16, 1993 [JP] Japan ..... 5-253828

[51] Int. Cl.[6] ..... D02G 3/00

[52] U.S. Cl. ..... 428/364; 428/394; 428/421; 428/422

[58] Field of Search ..... 428/364, 421, 428/422, 394

[56] References Cited

U.S. PATENT DOCUMENTS

| | | | |
|---|---|---|---|
| 3,655,853 | 4/1972 | Gallup . | |
| 3,953,566 | 4/1976 | Gore | 264/288 |
| 3,962,153 | 6/1976 | Gore | 264/210 R |
| 4,049,589 | 9/1977 | Sakane | 264/344 |
| 4,064,214 | 12/1977 | FitzGerald | 264/147 |
| 5,061,561 | 10/1979 | Katayama | 428/364 |

FOREIGN PATENT DOCUMENTS

| | | |
|---|---|---|
| 0069577 | 12/1983 | European Pat. Off. . |
| 1355373 | 6/1974 | United Kingdom . |

*Primary Examiner*—N. Edwards
*Attorney, Agent, or Firm*—Gary A. Samuels

[57] ABSTRACT

A filamentary material of polytetrafluoroethylene (PTFE) having an apparent density of 2.0 g/cc or more, tensile strength of 5 grams/denier or more, tensile elongation at break of 15% or more, high axial orientation and high crystalline content is disclosed. The filamentary material, when analyzed by differential scanning calorimetry, exhibits two endothermic peaks; the ratio of the energy defined by the higher temperature peak to the energy defined by the lower temperature peak being equal to or greater than 2.

7 Claims, 1 Drawing Sheet

POLYTETRAFLUOROETHYLENE FILAMENTARY MATERIAL

FIELD OF THE INVENTION

The invention relates to a novel continuous polytetrafluoroethylene fiber having high density and high strength.

BACKGROUND OF THE INVENTION

Polytetrafluoroethylene (PTFE) is well known for its chemical inertness, and for its excellent thermal and dielectric properties which make it a desirable material for use in a variety of applications, including many in which it is preferred for use as a fiber, yam, or other filamentary form. Hereinafter, for convenience, "fiber" may be used to describe filamentary forms in general.

Polytetrafluoroethylene fibers have been produced, as described in U.S. Pat. No. 3,655,853 (to Gallup), by forming a mixture of viscose and polytetrafluoroethylene particles in a dispersion, extruding the mixture through a spinneret into an acidic bath to form fibers consisting of a cellulosic matrix containing the polytetrafluoroethylene particles. After washing and rinsing, the fibers are heated to a temperature of about 370° C. to 390° C. to decompose the cellulosic material and to melt and coalesce the polytetrafluoroethylene particles. The fibers are then drawn at a ratio of about 4:1 to 35:1 at a temperature between 370° C. and 390° C. The fibers produced by this relatively complex and expensive process have a tensile strength generally less than 2 grams/denier, and may require further processing steps, such as bleaching to remove residual contaminants, which may lower the tensile strength. An improved process is described in U.S. Pat. No. 4,064,214 (to FitzGerald) in which the fibers are further processed through a fibdilating means, such as a high-velocity air jet. Yams in the 100–2000 denier range having tensile strength in the range 2–6 grams/denier are disclosed.

Another method to produce polytetrafluoroethylene fibers is described in U.S. Pat. Nos. 3,953,566, 3,962,153, and 4,064,214 (to Gore). In this method a paste formed by mixing a lubricant, such as a mineral spirit, with a fine powder of polytetrafluoroethylene produced by coagulation of an aqueous dispersion of polytetrafluoroethylene particles, is extruded and formed by conventional means to produce a tape or bead. The product thus formed, which may be slit to form fibers, is dried to remove the lubricant and subsequently stretched at a high rate, and at a temperature lower than the crystalline melt point of polytetrafluoroethylene, to produce a porous article. The porous article may then be heated while maintained in the stretched condition to a temperature above the melt point of crystalline polytetrafluoroethylene, generally considered to be in the range 327° C. to 345° C., to increase strength and dimensional stability. Fibers produced by this method have high tensile strength, typically 2–5 grams/denier and tensile modulus of elasticity in the range 60–180 grams/denier, and are essentially contaminant free. The fibers are porous, typically having an apparent density in the range 1.2–1.8 grams/cc. They can, however, have an apparent density as low as about 0.2 grams/cc, as can other porous forms of polytetrafluoroethylene made by the methods described. When analyzed by thermoanalytical methods such as differential scanning calorimetry (DSC), polytetrafluoroethylene articles made by these methods produce thermograms having two endothermic peaks; a higher intensity peak at a temperature of about 342° C.±5° C., and a lower intensity peak at a temperature of about 380° C.±5° C.

Another high temperature process to produce fibers of polytetrafluoroethylene is described in U.S. Pat. No. 5,061,561 (to Katayama), In this method a precursor fiber is prepared in accordance with the methods described in the Gore patents listed above and in Japanese Patent Publication No. 51-18891, and is subsequently stretched in a second stretching step at a temperature higher than the melt point of crystalline polytetrafluoroethylene. The precursor fiber is monoaxially oriented, has an orientation degree of 0.7– 0.9, a pore volume of 40–70 percent (corresponding to an apparent density of about 1.21 to 0.69 grams/cc), a tensile modulus of elasticity of about 60–180 grams/denier, and a tensile strength of about 2.8–4.0 grams/denier. The precursor fiber exhibits the characteristic two endothermic peaks of the stretched material, in the intensity relationship described above, at temperatures of 340° C.±5° C. and 380° C.±5° C. The precursor fiber is then generally twisted about 400 to 5000 turns per meter to improve its stability in the second stretching step, and to obtain a finished fiber having a circular cross-section.

In the second stretching step the precursor fiber is stretched an amount preferably 2:1 to 6.5:1 at a temperature usually between 360° C. and 420° C. In this step the precursor fiber is converted into a finished fiber having the properties: apparent density –2.15 to 2.3 grams/cc; orientation degree –0.9 or more; crystalline content 90% or more; tensile strength greater than 5 grams/denier; and tensile modulus of elasticity of 250–350 grams/denier or more. The finished fiber has relatively poor elongation capability. The finished fiber also exhibits the characteristic two endothermic peaks of the stretched material, in the intensity relationship described above, at temperatures of 345° C.±5° C. and 380° C.±5° C.

It is an objective of the invention to produce a polytetrafluoroethylene fiber having greater elongation capability than the fiber described immediately above without sacrificing other excellent characteristics, and without the need for processing such a fiber at the high temperatures required to exceed the crystalline melt point of polytetrafluoroethylene.

SUMMARY OF THE INVENTION

It has been discovered that a polytetrafluoroethylene fiber that has an apparent density of 2 or more, a degree of orientation of 0.9 or more, a crystalline content of 90 percent or more, a tensile strength of 5 grams/denier or more, and elongation at break of 15 percent or more can be made by stretching a precursor fiber at low stretch rates at a temperature below the crystalline melt point of polytetrafluoroethylene.

It has further been discovered that such a material when analyzed by thermoanalytical methods is characterized by a thermogram unlike any previously disclosed. The polytetrafluoroethylene fiber of the invention, when analyzed by differential scanning calorimetry (DSC) at a rate of 10° C./minute over a temperature range of 30° C. to 450° C., exhibits two endothermic peaks; one peak having a relatively low intensity in the temperature range 325° C. to 350° C., and the second peak having a much higher relative intensity in the temperature range 370° C. to 390° C.

Specifically, the invention is a filamentary material of polytetrafluoroethylene that, when analyzed by differential scanning calorimetry at a heating rate of 10° C./minute over a temperature range of 30° C. to 450° C., exhibits a first endothermic peak in the temperature range 325° C. to 350° C. and a second endothermic peak in the temperature range 370° C. to 390° C.; the ratio of the energy defined by the second peak to the energy defined by the first peak being equal to or greater than 2.

DETAILED DESCRIPTION OF THE INVENTION

Figure 1:
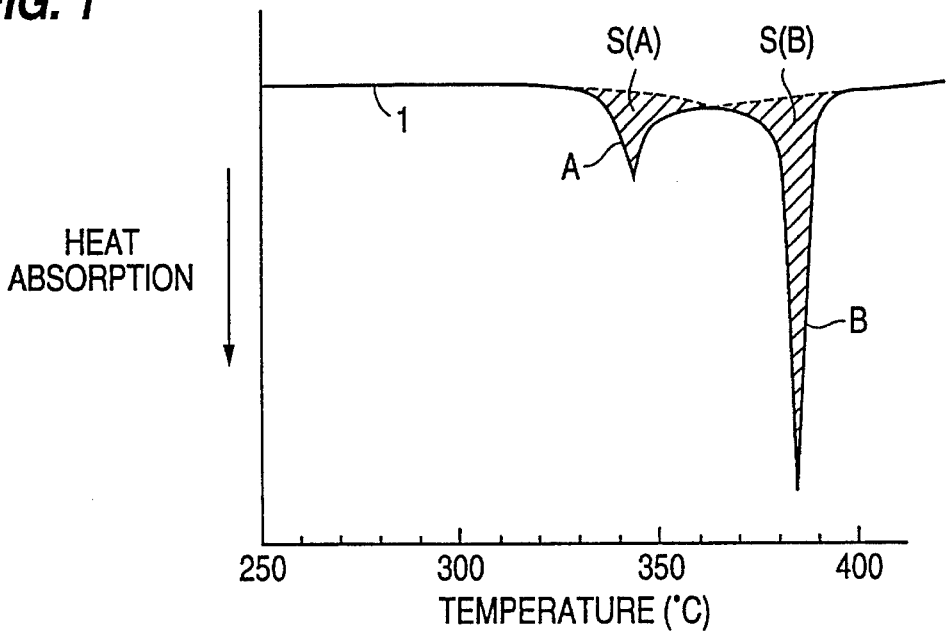
FIG. 1 is a thermogram obtained by DSC analysis of the fiber of the invention.

The filamentary material of the invention is made by first preparing a precursor fiber according to the methods disclosed in U.S. Pat. Nos. 3,953,566, 3,962,153, and 4,064,214 (to Gore). Fine powder polytetrafluoroethylene resin obtained by coagulation of an aqueous dispersion of PTFE particles is mixed with a lubricant, such as kerosene or mineral spirits, to form a paste. The fine powder PTFE resin should preferably be a high molecular weight PTFE resin and have a standard specific gravity (SSG) of 2.2 or less, preferably 2.18 or less; and crystalline content of at least 90 percent, as determined by measurements described hereinbelow. Preferably, the PTFE resin is a homopolymer of tetrafluoroethylene; however, copolymers containing small amounts (no more than 1 mol percent) of another monomer, for example, ethylene, chlorotrifluoroethylene, hexafluoropropylene, perfluoropropyl vinyl ether, etc., may also be used.

The mixture is extruded and, optionally, calendered to form a tape. The tape is dried to remove the lubricant and stretched in at least one direction at a temperature of 327° C. or less, an amount in the range 1.5:1 to 10:1, preferably in the range 2:1 to 8:1, at a stretch rate of at least 10%/second, and a porous tape having a structure of nodes interconnected by fibrils is obtained. The porous tape may optionally be heated while maintained in the stretched condition, to a temperature higher than the crystalline melt point of polytetrafluoroethylene. The porous tape may then be slit to a desired width to obtain the precursor fiber.

The precursor fiber is then subjected to a second stretching step. The second stretching step is also performed at a temperature of 327° C. or less, preferably in the range 300° C. to 320° C. The stretching rate should be in the range 0.9%/second to 10%/second. The stretch ratio (amount of stretch) should be 25:1 or more, preferably 30:1 or more. If desired, following the second stretching step, the fiber can be heated to a temperature above the PTFE melt point, preferably in the range 350° C. to 380° C. to improve dimensional stability and reduce subsequent heat shrinkage of the fiber.

The second stretching step can be accomplished using conventional methods and equipment. Preferably, the precursor fiber is passed by feed rolls operating at a speed $V_1$, and stretched in a heated stretching zone by stretching rolls operating at a speed $V_2>V_1$ and taken up at speed $V_2$. The heated stretching zone in which the fiber is heated in the range 300° C. to 320° C. can be a heated platen, an oven, a tube furnace, and the like; or a liquid bath containing molten potassium nitrate, sodium nitrate, sodium nitrite, or other inorganic materials, and the like. Preferably, the heated stretching zone is a heated platen on whose surface the fiber is stretched. Following the second stretching step, the fiber Gin be given a heat treatment at a temperature above the PTFE melt point, preferably in the range 350° C. to 380° C., while maintaining the fiber in a stretched condition. The heat treatment can also be performed using the types of equipment described above. If the heat treatment is performed using such equipment, the speed of the feed rolls and take-up rolls controlling passage of the fiber through the heat treatment zone should be the same speed so that the fiber is prevented from relaxing, and so that further stretching is prevented.

The stretching rate $R_{st}$(%/second) and the stretch ratio $M_{st}$ can be expressed by the following equations:

$$R_{st},\ \%/\text{sec.}=(V_2-V_1)/L\times(100/60)$$

$$M_{st}=V_2/V_1$$

where $V_1$ (meters/minute) is the peripheral speed of the feed roll; $V_2$ (meters/minute) is the peripheral speed of the stretching roll; and L (meters) is the distance between the feed and stretching rolls. The terms (100/60) are for conversion to %/second.

The filamentary material of polytetrafluoroethylene of the invention made as described above has the following properties: apparent density of 2.0 grams/cc or more, preferably 2.2 to 2.3 grams/cc; degree of orientation of 0.90 or more, preferably 0.95 or more; a crystalline content of 90 percent or more, preferably 95 percent or more, tensile strength of 5 grams/denier or more, preferably 6–8 grams/denier, and tensile elongation at break of 15 percent or more, preferably 15–30 percent. The material of the invention is further characterized in that, when analyzed by differential scanning calorimetry at a heating rate of 10° C./minute over a temperature range of 30° C. to 450° C., it exhibits a first endothermic peak in the temperature range 325° C. to 350° C. and a second endothermic peak in the temperature range 370° C. to 390° C.; the ratio of the energy defined by the :second peak to the energy defined by the first peak being equal to or greater than 2.

FIG. 1 is a thermogram obtained by DSC analysis of a sample of the material of the invention. The curve 1 of the thermogram is the curve representing the quantity of heat absorbed by a sample of the material of the invention when heated at 10° C./minute over the temperature range 30° C. to 450° C. The endothermic peak A and endothermic peak B indicate heat absorption attributed to melting of crystalline portions of the sample. It is thought that the lower temperature endothermic peak A is caused by the melting of familiar crystals present in the node sections of the structure, and the higher temperature endothermic peak B is caused by the melting of extended polymer chain crystals present in the fibril sections of the structure.

The areas, S(A) and S(B), under peaks A and B respectively, represent the amount of energy resulting front the crystal melting. The area S(B) defines a melting energy two or more times greater than the melting energy defined by area S(A). The relationship of the energies of melting defined by S(B) and S(A) obtained by DSC analysis are in significant contrast to the relationship of the energies of melting disclosed in U.S. Pat. No. 5,061,561, in fact, they are in approximately opposite relationship. This clearly indicates that the crystal structure of the material of the invention is significantly different than the crystal structure of the material disclosed in U.S. Pat. No. 5,061,561.

Figure 2:
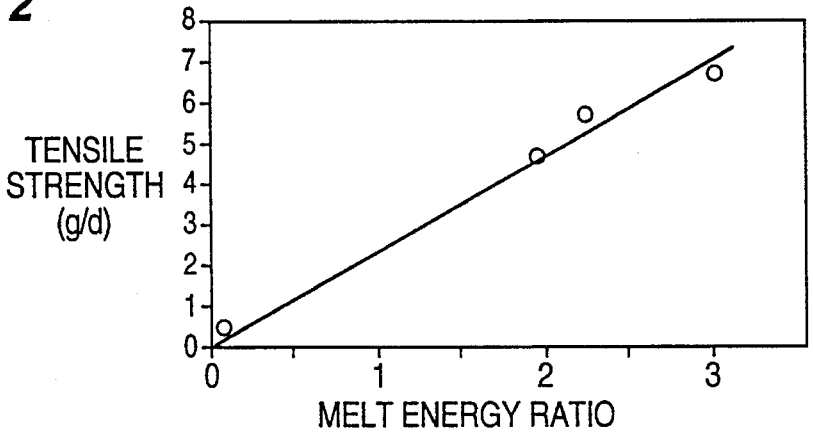
FIG. 2 is a graph representing the relationship between the melt energy ratio and tensile strength of the fiber of the invention.
Figure 3:
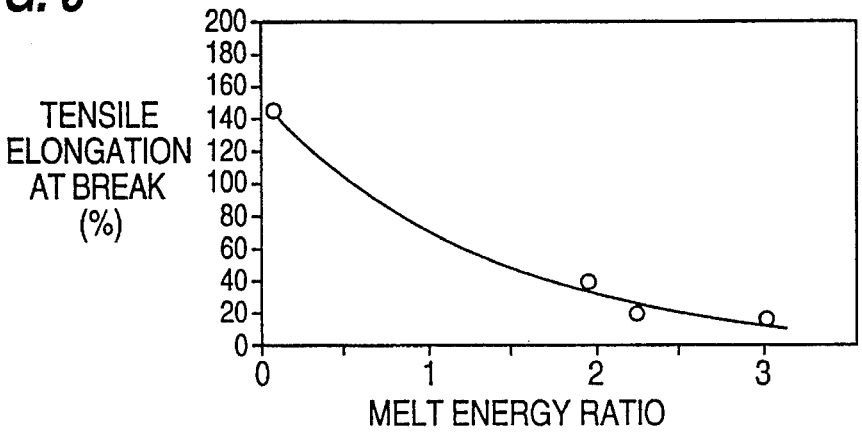
FIG. 3 is a graph representing the relationship between the melt energy ratio and elongation at break of the fiber of the invention.

Furthermore, the material of the invention, due to its different crystal structure, has a high tensile strength and markedly greater tensile elongation at break when compared to PTFE fibers formed by stretching at a temperature above 350° C. A relationship has been found between the melt energy ratio, defined as S(B)/S(A), and tensile properties of the material of the invention. FIG. 2 is a graph which illustrates the relationship between the melt energy ratio and tensile strength (grams/denier); and FIG. 3 is a graph which illustrates the relationship between the melt energy ratio and tensile elongation at break (%).

TEST DESCRIPTIONS

Standard Specific Gravity (SSG)

Standard Specific Gravity measurements are made according to ASTM Standard D1457.

Samples of PTFE resin are compressed in molds and heat treated to produce test billets according to the procedures described in the standard. The test billets, which are essentially void-free, are then used to obtain specific gravity values by liquid displacement methods or density gradient techniques.

Specific gravity was measured by a liquid displacement method using water containing 0.05% TRITON® X-100 wetting agent to lower the surface tension of the water.

Apparent Density

Apparent density is the weight per unit volume of a material, including voids inherent in the material as tested. It was measured by a liquid displacement method using water containing 0.05% TRITON® X-100 wetting agent to lower the surface tension of the water. Values are reported in grams/cc.

Degree of Orientation

The degree of orientation is determined by X-ray diffraction measurement of the (100) plane of the PTFE forming the fiber, which is then related to the orientation of the fiber axis.

The method is described at page 84 in the Textile Handbook ("Sen'i Binran"), edited by the Society of Textiles ("Sen'i Gakkai"), 3rd Printing (1974), published by Maruzen Co.

Crystalline Content

The crystalline content of the PTFE is measured by X-ray diffraction techniques. The crystalline content is determined by comparison of the area of the crystallinity peak, which is superimposed on the diffuse amorphous region, to the area of the amorphous; region, in the range, diffraction angle $2\theta$ =15° to 25°.

Tensile Properties

The samples were tested using an Instron Tensile Test Machine in an environment of 25° C. and 50% relative humidity.

Sample gauge length was 50 mm and crosshead speed was 200 mm/minute.

Thermal Analysis

The samples were analyzed by differential scanning calorimetry using a Seiko DCS-220 instrument using standard sample preparation procedures.

The samples were analyzed over the temperature range 30° C. to 450° C. at a heating rate of 10° C. per minute. The instrumental output included values for the energy of melting defined by the endothermic peaks A and B. A melt energy ratio was calculated from the energy of melting defined by peak A, S(A), and the energy of melting defined by peak B, S(B), as follows:

$$\text{Melt Energy Ratio}=S(B)/S(A)$$

The following examples are intended to further describe the invention and should not be construed as limiting the scope of the invention.

EXAMPLE 1

Following the procedures disclosed in U.S. Pat. Nos. 3,953,566, 3,962,153, and 4,064,214 a precursor fiber was prepared.

PTFE fine powder (crystalline content—93%; SSG—2.16) was mixed with kerosene to form a paste and extruded through a die to form a tape. The tape was dried at 200° C. to remove the kerosene. The tape was stretched longitudinally an amount of 3:1, at a rate greater than 10%/second, and at a temperature less than 327° C. The; stretched tape was then slit to form fibers of 2000 denier to serve as precursor fibers. The precursor fibers had an apparent density of 1.5 grams/cc, degree of orientation of 0.6, crystalline content of 90%, tensile strength of 0.42 grams/denier, tensile elongation at break of 145%, and a melt energy ratio 0.06.

The precursor fibers were given a second stretch step under a variety of conditions. The stretching conditions and obtained property values for the samples are shown in Tables 1–3.

The precursor fibers were stretched over a heated platen forming a stretching zone between the feed and stretching rolls, which were spaced 1.8 meters apart. The platen surfaces were heated to 300° C., 320° C., or 330° C. for the sample runs. The feed rolls were operated at surface speeds ($V_1$) in the range 0.02 to 4 meters/minute; and the stretching rolls were operated at surface speeds ($V_2$) in the range 1 to 91 meters/minute. The stretching rates, $R_{st}$, and stretch ratios, $M_{st}$, calculated from the speeds of the sample runs are shown in the tables. After the second stretching step the fibers were immediately fed over a high temperature platen with a surface temperature of 360° C. and taken up at a speed $V_2$, the same speed at which they were fed onto the high temperature platen.

Specimens from each of the sample runs were obtained and were measured to determine tensile properties, apparent density, degree of orientation, crystalline content, and melt energy ratio by the methods described hereinabove. The results are shown in Tables 1–3.

Specimens of known length from each of the sample runs were heated to 200° C. for 30 minutes in a constant temperature chamber, after which the length of each was remeasured to determine heat shrinkage. In all cases, heat shrinkage was less than 0.5%.

It can be seen from Tables 1 to 3 that the stretch ratio ($M_{st}$) of the second stretching step must be 25 or more in order to obtain a fiber having a tensile strength of at least 5 grams/denier and an elongation at break of 15% or more.

EXAMPLE 2

A precursor fiber was prepared as described in Example 1, except that it was slit to a size of 3200 denier.

The precursor fiber was stretched over a platen heated to 300° C. at a stretch ratio of 32: 1, and a stretch rate of 8%/second. The fiber was then immediately fed over a high temperature platen (surface temperature –360° C.) and taken up without further stretching.

The fiber of the invention obtained in this manner had a size of 100 denier. The fiber was tested as described in Example 1 and found to have the folowing properties: tensile strength of 6.5 grams/denier, elongation at break of 20%, apparent density of 2.24 grams/cc, degree of orientation of 0.97, crystalline content of 96%, and heat shrinkage less than 0.5%.

A sample of the fiber was analyzed by DSC analysis as described above, and produced the thermogram shown in FIG. 1. The endothermic peak A reached a maximum at 344° C., and the area under the peak S(A) defined a melt energy of 13.5 mJ/rag. The endothermic peak B reached a maximum at 382° C., and the melt energy defined by the area under the peak S(B) was 37.0 mJ/mg. The melt energy ratio was 2.74.

EXAMPLE 3

A fiber of the invention was made as described in Example 2, except that the fiber was taken up without passage over the high temperature platen.

The fiber was tested as described in Example 2 and found to have similar properties to the fiber of Example 2, except that heat shrinkage was about 5%.

COMPARATIVE EXAMPLE 1

A precursor fiber was prepared as described in Example 1, except that the PTFE fine powder had a crystalline content of 92% and SSG of 2.21.

The precursor fiber was stretched over a platen heated to 300° C. at a stretch ratio of 32:1, and a stretch rate of 8%/second. The fiber was then immediately fed over a high temperature platen (surface temperature –360° C.) and taken up without further stretching.

The fiber obtained in this manner was tested and found to have the following properties: tensile strength of 4.5 grams/denier, tensile elongation at break of 6%, apparent density of :2.23 g/cc, degree of orientation of 0.97, crystalline content of 95%, and melt energy ratio of 2.6.

The example illustrates the importance of the molecular weight of the PTFE resin starting material. The SSG of the starting resin was higher than 2.20 which is indicative of a molecular weight lower than desired, with the result that a fiber having a tensile strength of 5 grams/denier and tensile elongation at break of 15% or more could not be obtained.

COMPARATIVE EXAMPLE 2

Fibers were slit from the extruded and dried tape used to prepare the precursor fibers described in Example 1 before the tape was stretched. The fibers thus obtained were then stretched over a platen heated to 360° C. at a stretch rate of 8%/second.

The fibers could not be stretched an amount greater than 5:1, and tended to break. Fibers stretched at a stretch ratio of 4:1 had the following properties: tensile strength of 1.2 grams/denier, tensile elongation at break of 60%, apparent density of 1.8 g/cc, degree of orientation of 0.73, crystalline content of 40%, heat shrinkage or 3%, and a melt energy ratio of 0.45.

COMPARATIVE EXAMPLE 3

Fibers were prepared as described in Comparative Example 2, except that the platen temperature was 400° C. and the stretch rate was 10%/second.

The fibers broke at a stretch ratio of 3.

TABLE 1

| Sample No. | Stretching Temperature (°C.) | Rst (%/sec) | Mst | Tensile Strength (g/d) | Tensile Elongation at Break (%) | Apparent Density (g/cc) | Degree of Orientation (%) | Crystalline Content (%) | Melt Energy Ratio |
|---|---|---|---|---|---|---|---|---|---|
| 1 | 300 | 0.8 | 11 | 4.0 | 40 | 1.98 | 0.92 | 90 | 1.54 |
| 2 | 300 | 0.85 | 25 | 5.2 | 36 | 2.10 | 0.96 | 95 | 2.21 |
| 3 | 300 | 0.9 | 44 | 7.7 | 24 | 2.23 | 0.96 | 95 | 3.10 |
| 4 | 300 | 0.95 | 63 | 8.2 | 20 | 2.25 | 0.97 | 96 | 3.54 |
| 5 | 300 | 1.0 | 80 | 8.5 | 19 | 2.27 | 0.98 | 97 | 3.64 |
| 6 | 300 | 1.5 | 87 | 8.8 | 15 | 2.28 | 0.99 | 97 | 3.70 |
| 7 | 300 | 3.0 | 79 | 8.6 | 20 | 2.26 | 0.98 | 97 | 3.86 |
| 8 | 300 | 6.0 | 51 | 8.0 | 22 | 2.25 | 0.98 | 96 | 3.37 |
| 9 | 300 | 10 | 38 | 7.2 | 27 | 2.23 | 0.97 | 95 | 2.96 |
| 10 | 300 | 15 | 34 | 6.5 | 25 | 2.23 | 0.96 | 95 | 2.62 |
| 11 | 300 | 40 | 28 | 5.8 | 32 | 2.15 | 0.95 | 95 | 2.23 |
| 12 | 300 | 80 | 24 | 4.7 | 42 | 1.98 | 0.94 | 92 | 1.85 |

TABLE 2

| Sample No. | Stretching Temperature (°C.) | Rst (%/sec) | Mst | Tensile Strength (g/d) | Tensile Elongation at Break (%) | Apparent Density (g/cc) | Degree of Orientation (%) | Crystalline Content (%) | Melt Energy Ratio |
|---|---|---|---|---|---|---|---|---|---|
| 13 | 320 | 0.8 | 13 | 4.3 | 35 | 1.99 | 0.93 | 90 | 1.75 |
| 14 | 320 | 0.85 | 27 | 5.3 | 38 | 2.13 | 0.95 | 94 | 2.33 |
| 15 | 320 | 0.9 | 50 | 8.1 | 20 | 2.26 | 0.97 | 96 | 3.42 |
| 16 | 320 | 0.95 | 75 | 8.5 | 17 | 2.27 | 0.99 | 97 | 3.63 |
| 17 | 320 | 1.0 | 58 | 8.3 | 21 | 2.25 | 0.97 | 97 | 3.57 |
| 18 | 320 | 1.5 | 54 | 8.2 | 18 | 2.25 | 0.97 | 96 | 3.40 |
| 19 | 320 | 3.0 | 46 | 7.8 | 24 | 2.24 | 0.96 | 96 | 3.15 |
| 20 | 320 | 10 | 32 | 6.3 | 28 | 2.23 | 0.95 | 95 | 2.64 |

TABLE 2-continued

| Sample No. | Stretching Temperature (°C.) | Rst (%/sec) | Mst | Tensile Strength (g/d) | Tensile Elongation at Break (%) | Apparent Density (g/cc) | Degree of Orientation (%) | Crystalline Content (%) | Melt Energy Ratio |
|---|---|---|---|---|---|---|---|---|---|
| 21 | 320 | 15 | 29 | 5.8 | 28 | 2.16 | 0.95 | 94 | 2.25 |
| 22 | 320 | 40 | 21 | 4.4 | 28 | 1.99 | 0.93 | 90 | 1.62 |
| 23 | 320 | 80 | —* | — | — | — | — | — | — |

*Non-uniform stretching

TABLE 2

| Sample No. | Stretching Temperature (°C.) | Rst (%/sec) | Mst | Tensile Strength (g/d) | Tensile Elongation at Break (%) | Apparent Density (g/cc) | Degree of Orientation (%) | Crystalline Content (%) | Melt Energy Ratio |
|---|---|---|---|---|---|---|---|---|---|
| 24 | 330 | 0.8 | 17 | 4.3 | 25 | 1.99 | 0.93 | 90 | 1.70 |
| 25 | 330 | 0.85 | 28 | 5.8 | 21 | 2.15 | 0.95 | 93 | 2.25 |
| 26 | 330 | 0.9 | 44 | 7.6 | 17 | 2.23 | 0.96 | 94 | 3.03 |
| 27 | 330 | 0.95 | 47 | 8.1 | 15 | 2.24 | 0.97 | 95 | 3.27 |
| 28 | 330 | 1.0 | 43 | 7.7 | 20 | 2.22 | 0.96 | 94 | 3.16 |
| 29 | 330 | 1.5 | 44 | 7.6 | 19 | 2.22 | 0.96 | 94 | 3.14 |
| 30 | 330 | 3.0 | 31 | 6.0 | 27 | 2.17 | 0.95 | 93 | 2.50 |
| 31 | 330 | 6.0 | 18 | 4.6 | 30 | 1.99 | 0.94 | 90 | 1.72 |
| 32 | 330 | 10 | —* | — | — | — | — | — | — |

*Non-uniform stretching

I claim:

1. A polytetrafluoroethylene fiber, said fiber, when analyzed by differential scanning calorimetry over a temperature range of 30° to 450° at a heating rate of 10° C./minute, exhibiting a first endothermic peak in the temperature range 325° to 350° C. and a second endothermic peak in the temperature range 370° to 390° C.;

a melt energy ratio of the second peak to that of the first peak being equal to or greater than 2.

2. The fiber as recited in claim 1 wherein said fiber has an elongation at break of 15 percent or more.

3. The fiber as recited in claim 2 wherein said fiber has a maximum tensile strength of 5 grams/denier or more.

4. The fiber as recited in claim 3 wherein said fiber has a degree of orientation of 0.9 or more.

5. The fiber as recited in claim 4 wherein said fiber has a crystalline content of 90 percent or more.

6. The fiber as recited in claim 5 wherein said fiber has an apparent density of 2.0 g/cc or more.

7. A polytetrafluoroethylene fiber;

said fiber comprising polytetrafluoroethylene resin having a standard specific gravity of 2.20 or less.

said fiber formed by stretching a precursor fiber having an apparent density of 1.8 grams/cc or less at a stretch rate of 10%/second or less, at a temperature of 320° C. or less;

said fiber, when analyzed by differential scanning calorimetry over a temperature range of 30° to 450° C. at a heating rate of 10° C./minute, exhibiting a first endothermic peak in the temperature range 325° to 350° C. and a second endothermic peak in the temperature range 370° to 390° C.;

a melt energy ratio of the second peak to that of the first peak being equal to or greater than 2.

* * * * *